United States Patent [19]

Erickson

[11] Patent Number: 4,775,399

[45] Date of Patent: Oct. 4, 1988

[54] AIR FRACTIONATION IMPROVEMENTS FOR NITROGEN PRODUCTION

[76] Inventor: Donald C. Erickson, 1704 S. Harbor Ln., Annapolis, Md. 21401

[21] Appl. No.: 121,527

[22] Filed: Nov. 17, 1987

[51] Int. Cl.[4] ..... F25J 3/04

[52] U.S. Cl. ..... 62/22; 62/29; 62/38

[58] Field of Search ..... 62/22, 29, 38

[56] References Cited

U.S. PATENT DOCUMENTS

| | | | |
|---|---|---|---|
| 2,280,383 | 4/1942 | De Baufre | 62/29 |
| 2,699,046 | 1/1955 | Entienne | 62/29 |
| 3,127,260 | 3/1964 | Smith | 62/22 |
| 3,500,651 | 3/1970 | Becker | 62/29 |
| 3,688,513 | 9/1972 | Streich et al. | 62/22 |
| 3,729,943 | 5/1973 | Petit | 62/22 |
| 4,433,989 | 2/1984 | Erickson | 62/22 |
| 4,433,990 | 2/1984 | Olszewski | 62/22 |
| 4,453,957 | 6/1984 | Pahade et al. | 62/29 |
| 4,533,375 | 8/1985 | Erickson | 62/22 |
| 4,578,095 | 3/1986 | Erickson | 62/22 |
| 4,604,116 | 8/1986 | Erickson | 62/22 |
| 4,605,427 | 8/1986 | Erickson | 62/22 |

*Primary Examiner*—Ronald C. Capossela

[57] ABSTRACT

Method and apparatus for achieving high yields of high purity $N_2$ and optional coproduct $O_2$ at lower energy and capital cost than heretofore possible are disclosed. Referring to FIG. 1, in a dual pressure configuration comprised of a rectifier (105) and a column (102), warm companded air from a compressor (118) provides bottom reboil at the reboiler (103), and the liquid air is split to reflux both columns. The refrigeration expander (112), driven by expansion of waste $O_2$, provides the power for the compressor (112). Also kettle liquid is distilled into two vapor streams by a contact zone (107) before feeding to the column (102).

23 Claims, 7 Drawing Sheets

AIR FRACTIONATION IMPROVEMENTS FOR NITROGEN PRODUCTION

TECHNICAL FIELD

Process and apparatus are disclosed for fractionally distilling air to produce high yields of high purity nitrogen at lower energy consumption than has been possible heretofore. The disclosure extends to coproduct $O_2$ production as well.

BACKGROUND ART

Nitrogen is widely used in industrial and commercial operations. It is most efficiently and economically produced in large tonnage quantities by cryogenic distillation of air. There has been a continuing effort to improve those processes so as to reduce the energy requirement and the capital cost of the equipment.

When nitrogen is the primary value product from air separation, as opposed to oxygen, the cryogenic production plants and corresponding processes fall into two groupings: single pressure distillation, and dual pressure distillation. The former group is generally lower in capital cost and more compact, and hence tends to be used in smaller capacity plants, whereas the latter (dual pressure) group is more energy efficient, which makes it most economic at larger capacities.

The single pressure distillation category entails feeding at least the bulk of the compressed, cleaned and cooled supply air to a single pressure column, which may or may not be reboiled at the bottom. The bottom liquid is reduced in pressure and placed in latent heat exchange relationship with overhead vapor, thereby being reevaporated and simultaneously providing liquid nitrogen ($LN_2$) reflux to the column. Product gaseous $N_2$ is withdrawn from the column overbead. U.S. patents in this category include U.S. Pat. Nos. 3,203,193, 3,217,502, 3,492,828, 3,736,762, 4,400,188, 4,464,188, 4,566,887, 4,594,085, 4,595,405, 4,617,037, 4,662,917, 4,668,260, 4,696,689, and 4,698,079. They differ in regard to bow the column is reboiled, if at all, and in how the necessary refrigeration effect is produced. The '762, '193, '502, '828, '887, '405, '079, '260, and '689 patents disclose no bottom reboil, i.e., the column is simply a rectifier, with the supply air routed to the bottom. The '0188, '828, and '917 patents disclose bottom reboil via recycling $N_2$ out of the cold box to a compressor, and then back in to the reboiler. The '4188, '085, and '917 patents disclose bottom reboil via total condensation of part of the supply air after compression to a higher-than-column pressure. Finally, the '037 patent discloses bottom reboil via a closed cycle heat pump which circulates air as working fluid.

There are similarly several disclosures of refrigeration method.

Prior art patents which disclose dual pressure distillative production of nitrogen include U.S. Pat. Nos. 4,617,036, 4,604,117, 4,582,518, 4,543,115, 4,453,957, 4,448,595, 4,439,220, 4,222,756 and British Pat. No. 1,215,377. They all involve supplying feed air to a high pressure rectifier, then routing the rectifier bottom product either directly or indirectly to a low pressure distillation column, and several also involve supplying reboil to the low pressure column by latent heat exchange with vapor from the HP rectifier. Most also incorporate a means of increasing the reflux at the top of the LP column, whereby $N_2$ purity and yield are increased, by exchanging latent heat between LP column overhead vapor and boiling depressurized LP column bottom product.

The '377 patent was one of the earliest disclosures of the basic configuration described above. It included the option of withdrawing some product $N_2$ from the HP rectifier overhead, in addition to that withdrawn from the LP column overhead. The '957 patent discloses the same basic configuration, with the modifications of a different method of producing refrigeration and elimination of any transport of liquid $N_2$ from the HP rectifier overhead to the LP column overhead. The '756 patent also involves the same basic configuration, also eliminates flow of $LN_2$ from HP rectifier overhead to LP column overhead, and discloses yet another variation for producing refrigeration.

The '220 and '595 patents do not involve reboiling the LP column by latent heat exchange between HP rectifier vapor and LP column liquid. Rather, both of those patents disclose refluxing the HP rectifier by exchanging latent heat with boiling depressurized kettle liquid (HP rectifier bottom product). The at least partially evaporated kettle liquid is then fed into the LP column for further separation. This same technique has been disclosed in processes for producing low purity oxygen, e.g. U.S. Pat. Nos. 4,410,343 and 4,254,629. The latter patent explains by means of a McCabe-Thiele diagram the advantage of this technique—that feeding 40% $O_2$ vapor to the LP column is more efficient than feeding 40% $O_2$ liquid to the same column.

The primary difference between the '220 patent and the '595 patent is that in the '220 patent the LP column is solely a rectifier with no source of reboil other than the vapor feed to it, whereas in the '595 patent the LP column has a stripping section and a reboiler supplied by total condensation of part of the feed air. The latter means of reboiling the LP column is also disclosed in the U.S. Pat. No. 4,410,343 for low purity oxygen producing processes.

The '115 patent discloses a conventional dual pressure configuration with two novelties: the refrigeration is developed by expanding part of the HP rectifier supply air before it is introduced into the HP rectifier; and also part of the supply air is furnished at a pressure intermediate to that of the two distillation columns, and is totally condensed to provide intermediate reboil to the LP column before being fed thereto.

The '518 patent discloses a dual pressure apparatus requiring only a single air supply pressure wherein the lower pressure column is bottom-reboiled by partial condensation of the supply air, which significantly reduces the required supply pressure.

The '117 patent discloses supplying only a minor fraction of the supply air to the HP rectifier, which achieves less than the usual degree of separation, with the remaining air being work-expanded to LP column feed pressure. The resulting $N_2$ recovery is undesirably low.

The '036 patent does not provide LP column overhead reflux via latent heat exchange with depressurized bottom liquid. Instead, the bottom liquid is evaporated at very close to the bottom pressure, and then is work-expanded. The expansion drives a cold $N_2$ compressor which increases the delivery pressure of the $N_2$ product (from the LP column overhead).

In spite of the extensive variety of cryogenic air distillation processes for $N_2$ production, and the years of search for improvements, problems still remain. Many disclosures seek to increase the efficiency of the distillation column(s), by adding intermediate reboil or intermediate reflux. Unfortunately this has normally required an offsetting undesirable feature, such as lower $N_2$ recovery, or requiring a stream to be recycled out of and back into the cold box, or not providing any effective means of putting to advantage the refrigeration expander work, or requiring the low pressured column to operate relatively close to ambient pressure (e.g. below 4 atmospheres absolute) where system and line pressure drops become a very significant loss, and also column diameter becomes a significant cost item.

Accordingly it is one object of this invention to provide an improved air distillation process for nitrogen production which overcomes the limitations of the prior art processes by avoiding the above undesirable features. Surprisingly it has now been discovered that a novel combination of elements or techniques previously known in the $N_2$-generation art provides the solution to the longstanding problems of increasing the energy efficiency of both the single pressure and dual pressure cryogenic distillation $N_2$ production processes, while not increasing their cost, by avoiding the above-enumerated disadvantages.

DISCLOSURE OF INVENTION

The disadvantages identified in the prior art are overcome by providing an air distillation process or apparatus in which a minor fraction of the compressed and cleaned supply air is additionally compressed by a warm compressor powered by the refrigeration expander, and then is totally condensed so as to provide reboil to a distillation column having bottoms reboil and from which product $N_2$ is withdrawn overhead. At least part of the resulting condensed air is subsequently depressurized and fed into the column above the primary feed point so as to provide intermediate reflux. The column bottom liquid is partially depressurized so as to exchange latent heat with column overhead vapor, thus providing column reflux liquid ($LN_2$) and a waste $O_2$ vapor stream (about 70 to 95% purity) at about 2 to 3 atmospheres absolute (ATA) pressure. The waste stream is partially warmed and then work-expanded, with at least part of the expansion work driving the previously mentioned warm compressor.

This improvement applies to both single and dual pressure processes. With single pressure, the remaining major stream of supply air is fed directly to the column feed point after cooling to near its dewpoint. The primary variation in the single-pressure embodiment of this invention is whether the total condensation feed (air) reboil (TCFR) step reboils the bottom of the distillation column or an intermediate height. In the latter case (intermediate height) there must also be another reboil mechanism for the bottom reboil. The disclosed novel mechanism is a second expander for the waste $O_2$ which powers a cold compressor which directly compresses column overhead $N_2$ to a pressure sufficient to bottom reboil the column via condensation and latent heat exchange. The resulting $LN_2$ is returned to the column overhead as reflux. Clearly this cold-companded $N_2$ reboil technique could be used to provide intermediate reboil as well as bottoms reboil.

In the dual pressure (double column) embodiment of this invention, the remaining major fraction of the supply air is routed to the HP rectifier, and also part of the liquid air is fed to an intermediate reflux location of the HP rectifier. The primary variations are how the vapor duty at the top of the HP rectifier is transformed into vapor duty of the lower pressure column. The prior art discloses two means of doing this, both of which are also applicable here. The HP rectifier overhead $N_2$ can be routed to an intermediate reboiler for the LP column, so as to indirectly exchange latent heat. Secondly at least part of the HP rectifier bottom liquid ("kettle liquid") can be depressurized to LP column pressure and evaporated by latent heat exchange with HP rectifier $N_2$, thus forming vapor feed for the LP column. The preferred approach, novel to this disclosure, is to depressurize at least part of the kettle liquid to LP column pressure as above, but then to evaporate it in conjunction with a counter-current vapor-liquid contact device, whereby two vapor streams of differing $O_2$ content arc obtained—one with more $O_2$ than kettle liquid, and the other with less. The respective streams are then fed to different heights of the LP column, the higher $O_2$ content stream to a lower height. This "kettle liquid distillation (KELDIST) technique transfers reboil from the HP rectifier overhead to the LP column at a lower height (higher $O_2$ content) than is possible with previous disclosures, thereby increasing the $N_2$ recovery possible from a given amount (both mass flow and pressure ratio) of companded TCFR.

It will be recognized that both the KELDIST technique and the cold companded $N_2$ reboil technique are novel disclosures which can be advantageously applied independently of the companded TCFR technique, but that the greatest advantage is obtained from the disclosed combination with companded TCFR in most applications.

In its most efficient configuration for production of high purity $N_2$ only (e.g. from 99.9% to 99.99+% purity), the dual pressure embodiment of this invention inherently produces a waste gas of about 80%) $O_2$ composition. Although normally used for mol sieve regeneration, that stream could alternatively be a coproduct. With some additional energy input (i.e. higher air supply pressure), the $O_2$ coproduct purity can be increased to about 95%, at essentially full recovery, or even higher purity at reduced recovery.

One important aspect of this invention from the viewpoint of achieving the desired result is the proper selection of both the amount of air to be additionally compressed, and also the pressure ratio. In all cases no more than about 25% of the air is to be additionally compressed, and through a pressure ratio of at least about 1.07. In the dual pressure embodiment, the preferred quantity of air compressed is about 15%, and the preferred pressure ratio is about 1.12, e.g. from 10 ATA to 11.2 ATA. In the single pressure embodiment, the preferred quantity of air compressed is about 6 to 7%, and the preferred pressure ratio is about 1.44, e.g. from 6.7 ATA to 9.6 ATA.

It would be possible, and within the scope of the broadest aspect of this invention, to provide for process refrigeration and TCFR compander drive by expanding some stream other than the waste $O_2$ stream. Possible examples include HP rectifier $N_2$, the companded air stream itself, an LP column waste stream (particularly when coproduct $O_2$ is desired), and LP column bottom product vapor. However, as recited above this has the disadvantageous result of lowering column pressure(s), and hence increasing the significance of component pressure drop losses, and also increasing the size oi many components.

It would similarly be possible, and also within the broadest scope of this invention, to apply the KELDIST technique in conjunction with other known means of reboiling the bottom of the lower pressure column, e.g. by partial condensation of all the supply air, as disclosed in U.S. Pat. No. 4,582,518. Surprisingly, even though the power developed by the refrigeration expander is quite small (on the order of 1% of the main supply air compressor power), and as a result both the quantity of additional compression (by warm companding) and the pressure ratio of additional compression are quite small, nonetheless that amount is adequate and appropriate to drive the disclosed companded TCFR technique, and increase distillation column efficiency to where a 3 to 5% overall energy reduction is achievable. There is only minimal negative impact, if any, on the capital cost, since dissipating expander power through a warm compressor costs approximately the same as through a generator.

The technique of distilling kettle liquid into at least two streams of differing $O_2$ content before feeding them to separate heights of the LP distillation column in an oxygen production process was disclosed by the present applicant in co-pending application Ser. No. 893,045 filed Aug. 1, 1986, now U.S. Pat. No. 4,737,177, and Ser. No. 010,332 filed Feb. 3, 1987.

Reboiling a single pressure air distillation column via cold-companded $N_2$ or air has previously been disclosed by the applicant in U.S. Pat. No. 4,357,153.

BRIEF DESCRIPTION OF THE DRAWINGS

The first four figures illustrate preferred variations of the dual pressure embodiment of this invention, and the remaining three figures illustrate single pressure variations. All seven figures illustrate the preferred refrigeration technique oi evaporating depressurized distillation column bottom liquid (low purity or waste $O_2$) in the column reflux condenser at a pressure sufficiently above ambient pressure and then expanding it to ambient or discharge pressure.

BEST MODE FOR CARRYING OUT THE INVENTION

Figure 1:
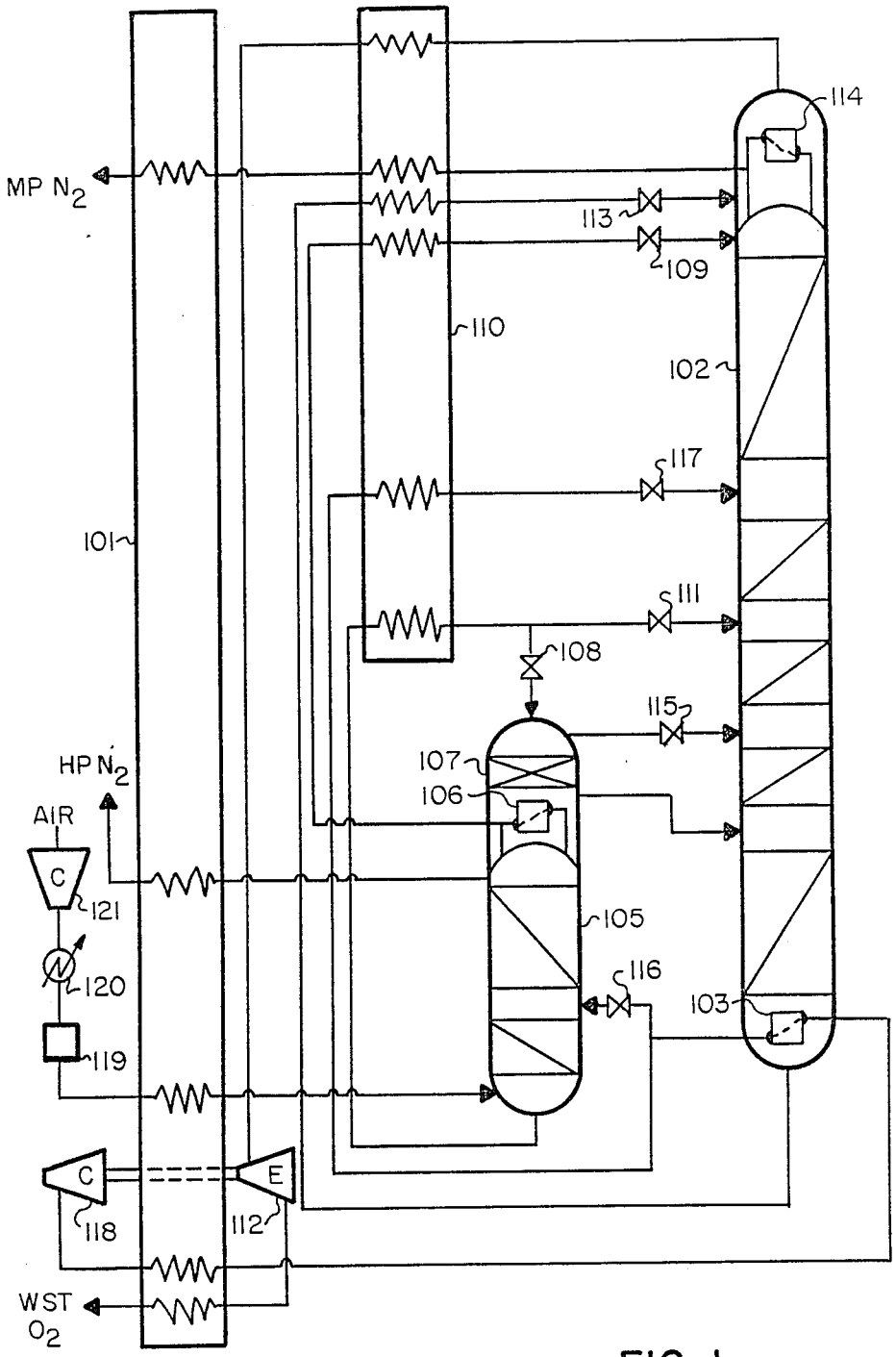
FIG. 1 illustrates distillation column bottoms reboil via companded TCFR, with subsequent split of the liquid air into two intermediate reflux streams, and also illustrates the KELDIST technique for feeding HP rectifier kettle liquid to the LP column at multiple feed heights.

Referring to FIG. 1, supply air which has been compressed in compressor 121 (to a pressure between about 8 and 11 ATA), cooled in cooler 120, and optionally cleaned in cleaner 119 (e.g. a molecular sieve unit), is further cooled to near its dewpoint in main heat exchanger 101 (which is normally comprised of several interconnected units or cores). It is then routed to HP rectifier 105. A minor fraction of the air (about 16%) is additionally compressed in compressor 118 before cooling in exchanger 101, and then routed to bottoms reboiler 103 of distillation column 102. The resulting liquid air is split by coordinated action of valves 116 and 117 into respective intermediate height reflux streams for column 102 and HP rectifier 105. Bottom liquid from HP rectifier 105 is routed to the top of vapor-liquid countercurrent contactor 107, through valve 108, and optionally part is also fed directly to column 102 via valve 111. The reboil vapor for contactor 107 is provided from reflux condenser 106, which also supplies reflux liquid ($LN_2$) for HP rectifier 105. Preferably some of the $LN_2$ is also routed to column 102 as overhead reflux through subcooler 110 and depressurization valve 109. Fluid streams comprised at least of vapor are withdrawn from both above and below contact zone 107, with the result that they have differing $O_2$ contents: one with a higher $O_2$ proportion than the kettle liquid, and the other with a lower proportion. The two streams are fed to different heights of column 102, using appropriate means to control the relative amount of flow in each stream such as valve 115. The bottom liquid from column 102 is subcooled in heat exchanger 110, depressurized to below column 102 pressure by valve 113, and evaporated by latent heat exchange with column 102 overhead vapor in reflux condenser 114. The resulting waste $O_2$ vapor, of typically about 60 to 90% $O_2$ purity (e.g. 75%), is then partially warmed and work-expanded in expander 112. The compressor 118 is preferably directly coupled to and driven by expander 112. This flowsheet is greatly smplified to show only the essential aspects of the inventive entity in a typical environment, and other known and obvious equivalents may be present, for example additional heat exchangers, liquid draws, other product draws (e.g. $O_2$), other means for liquid depressurization (e.g. hydraulic turbines, liquid jet ejectors, etc.).

Figure 2:
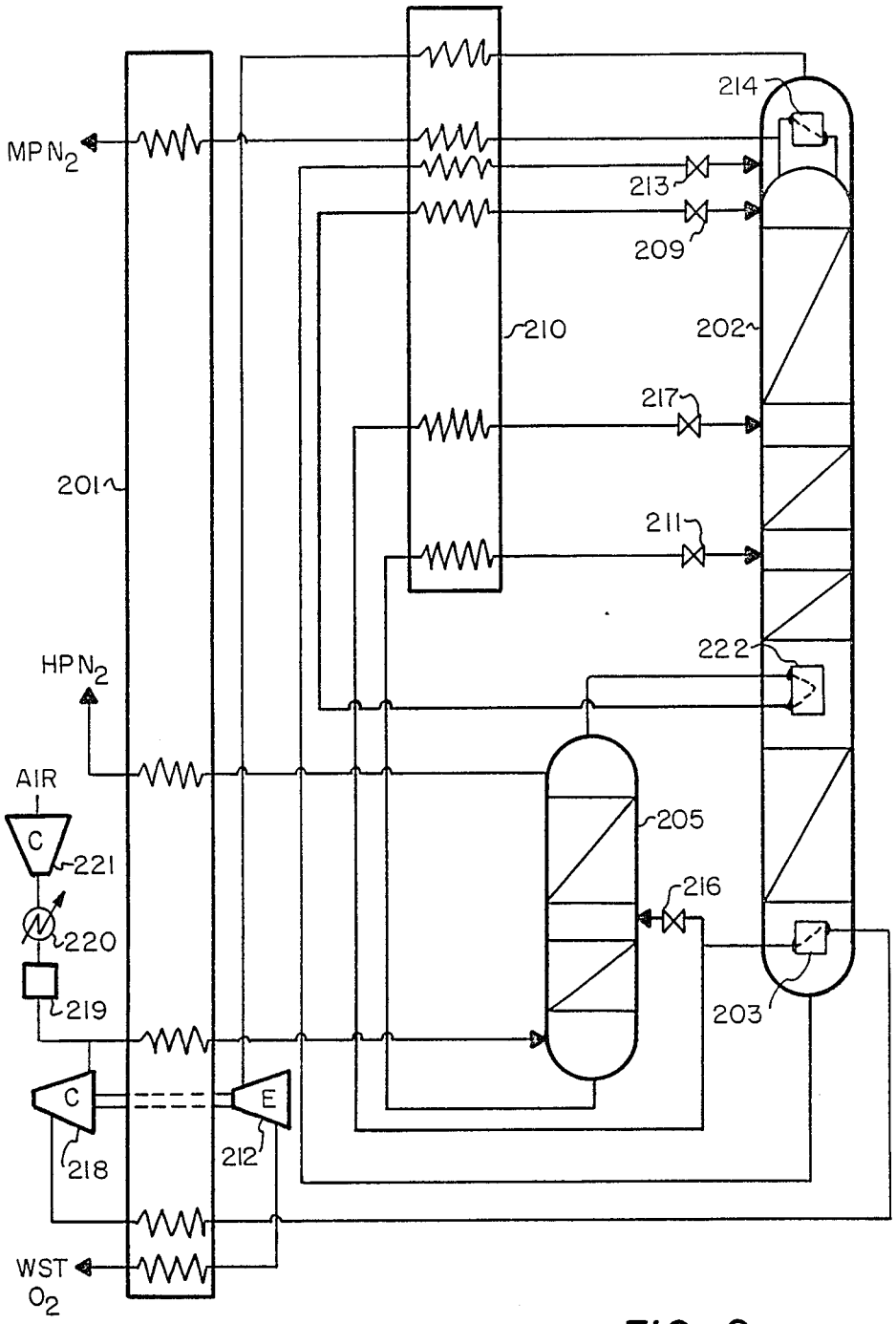
FIG. 2 illustrates another method of transforming HP rectifier vapor duty into LP column vapor duty: an intermediate reboiler in the LP column.

In FIG. 2, the 200-series components have the same description as the corresponding 100-series components of FIG. 1, and only the diferences will be described. In addition to the companded TCFR bottoms reboiler 203, column 202 is also reboiled at an intermediate height by intermediate reboiler 222, which is also the reflux condenser for HP rectifier 205. Thus reboiler 222 transfers vapor duty from rectifier 205 to column 202, in lieu of condenser 106, contact zone 107, and valves 108 and 115 of FIG. 1. Although the FIG. 2 configuration has mechanically fewer components, the FIG. 1 configuration allows column 102 and rectifier 105 to be located at heights which are independent of each other, thus reducing the overall cold box height.

Referring to FIG. 3, once again the 300-series components have the same description as the corresponding 100-series components of FIG. 1, and only the differences will be described. The bottoms reboiler 303 of column 302 is a partial condensation reboiler, as differentiated from the total condensation reboiler of FIG. 1.

Essentially all of the cooled, compressed, and cleaned supply air is routed through reboiler 303, wherein a minor fraction (on the order of 15 to 20%) condenses. Optional phase separator 304 allows only the remaining uncondensed portion to be directed to the bottom of HP rectifier 305, with the liquid portion being combined with the kettle liquid. Similar to FIGS. 1 and 2, product $N_2$ is withdrawn from the overhead of column 302 at about 5.5 ATA in the range of 5 to 6.5 ATA) and also optionally from the overhead of rectifier 305 at about 9.5 ATA (9 to 11), and waste $O_2$ is expanded from about 2 ATA to about 1.25 ATA. The refrigeration can alternatively be obtained by expanding HP rectifier gaseous $N_2$ product to LP column pressure, resulting in only a single $N_2$ delivery pressure of about 4 ATA, and also lowering the pressure of both columns. $N_2$ recovery is between about 70 and 75 of the available 78 moles per 100 moles oi compressed air.

Figure 4:
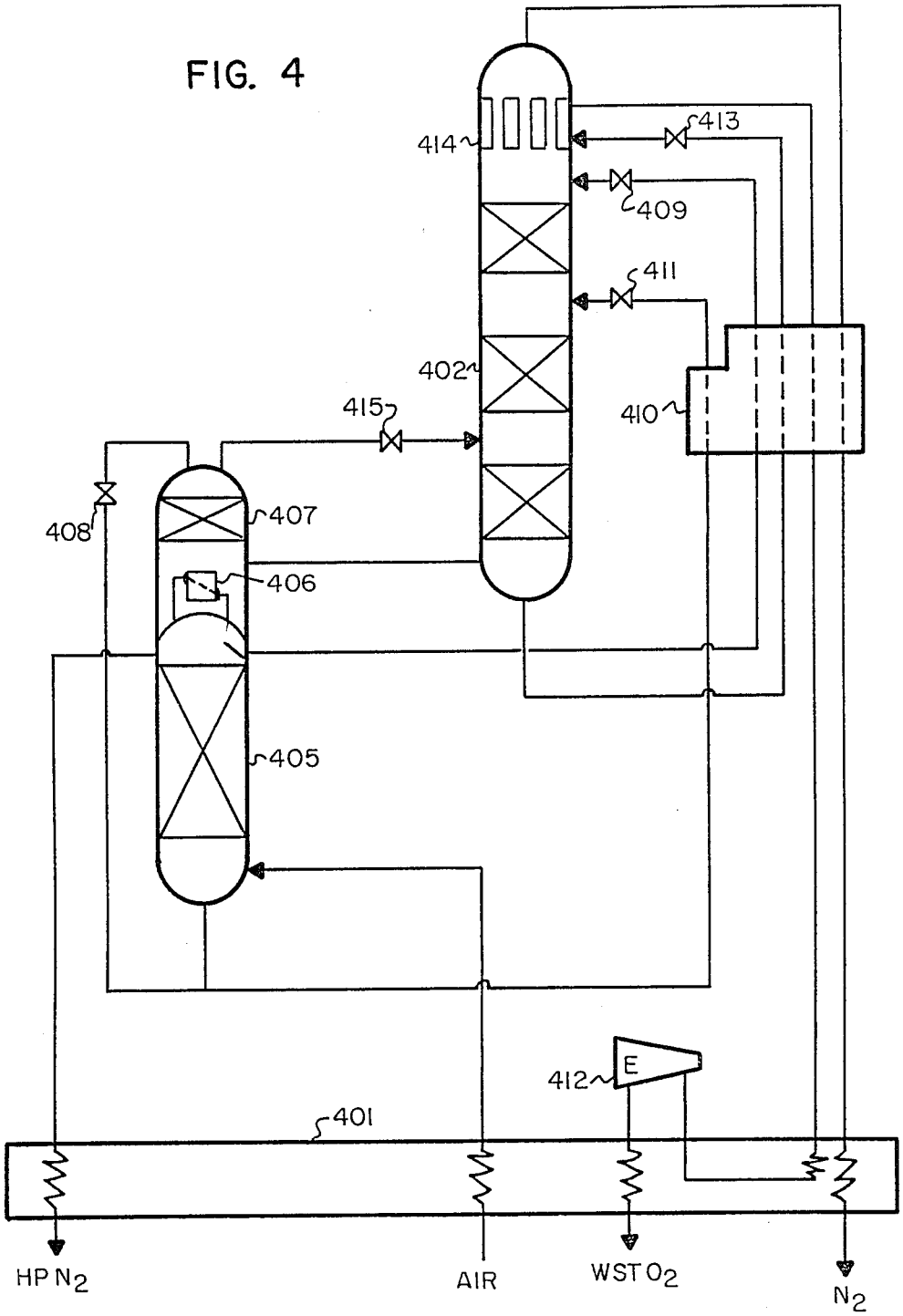
In FIG. 4, the KELDIST technique is combined with an LP column which is not bottom reboiled, i.e., which is also only a rectifier, having vapor feed to the bottom, similar to the HP rectifier.

The remaining dual pressure column variation illustrated, FIG. 4, does not have a separate bottoms reboiler for LP column 402. One of the KELDIST vapor streams, from below contact zone 407, is supplied directly to the bottom of column 402 for rectification. Thus a very low overall height configuration is achieved, but at reduced $N_2$ recovery and energy efficiency.

Figure 3:
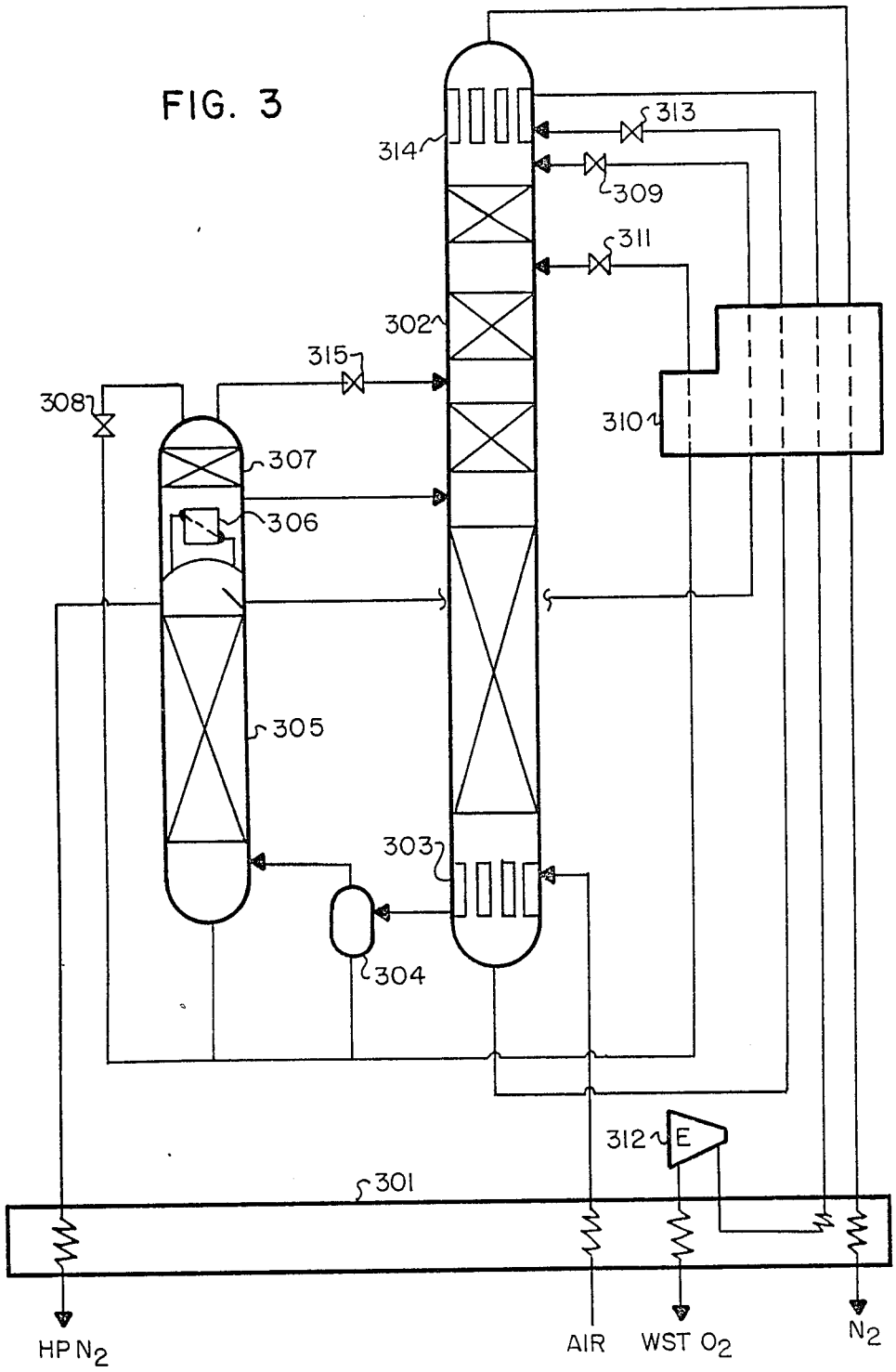
FIG. 3 retains the KELDIST feature of FIG. 1, but combines it with LP column bottoms reboil via partial condensation of the feed air (PCFR) vice TCFR.

The advantage of the companded TCFR/LAIR-SPLIT technique is best illustrated with reierence to FIGS. 1 and 3. The slight amount of companding obtainable from the refrigeration expander is sufficient to raise the condensing temperature oi totallY condensing liquid air to equivalence with that of partially condensing air. Thus the resPective columns and rectifiers can operate at essentially the same pressure. However, the vapor feed to the HP rectifier has lightly higher $O_2$ content (e.g. 20.93% vice 19%) and also part of the reflux to both column and rectifier is supplied at an intermediate height (between about 5 and 10% of total air supply to each column as liquid air). Both of these effects act to enable more $N_2$ product to be withdrawn from the HP rectifier vice the column. Whereas with FIG. 3 about 20 m (m=moles per 100 moles of compressed air) $N_2$ is taken from the rectifier and about 51.2 m irom the column, with FIG. 1 the HP rectifier product is increased to the range of about 25 to 30 m, and the overall $N_2$ yield is increased by about 1 m, without any increase in supply pressure.

The KELDIST technique is also important in regard to achieving the above advantageous results. Since the companded TCFR reboil amount ia amall, it is limited in the amount of additional stripping (of $N_2$ out of the $O_2$) that it can provide. If that stripping were applied to a column in which the lowest feed were evaporated kettle liquid, of about 34% $O_2$ content, the $N_2$ necessarily remaining in the bottom liquid would be undesirably high. But with KELDIST, the lowest vapor feed has an $O_2$ content higher than that of the kettle liquid, thus permitting a correspondingly higher $O_2$ content (and lower $N_2$ content) in the column bottom liquid. Of course, in some special circumstances that additional recovery may not be desired, in which the more conventional KELBOIL (kettle liquid boil) technique may be utilized, e.g. by the simple expedient of shutting valve 115, 315, or 415 (or deleting the contact zone).

Figure 5:
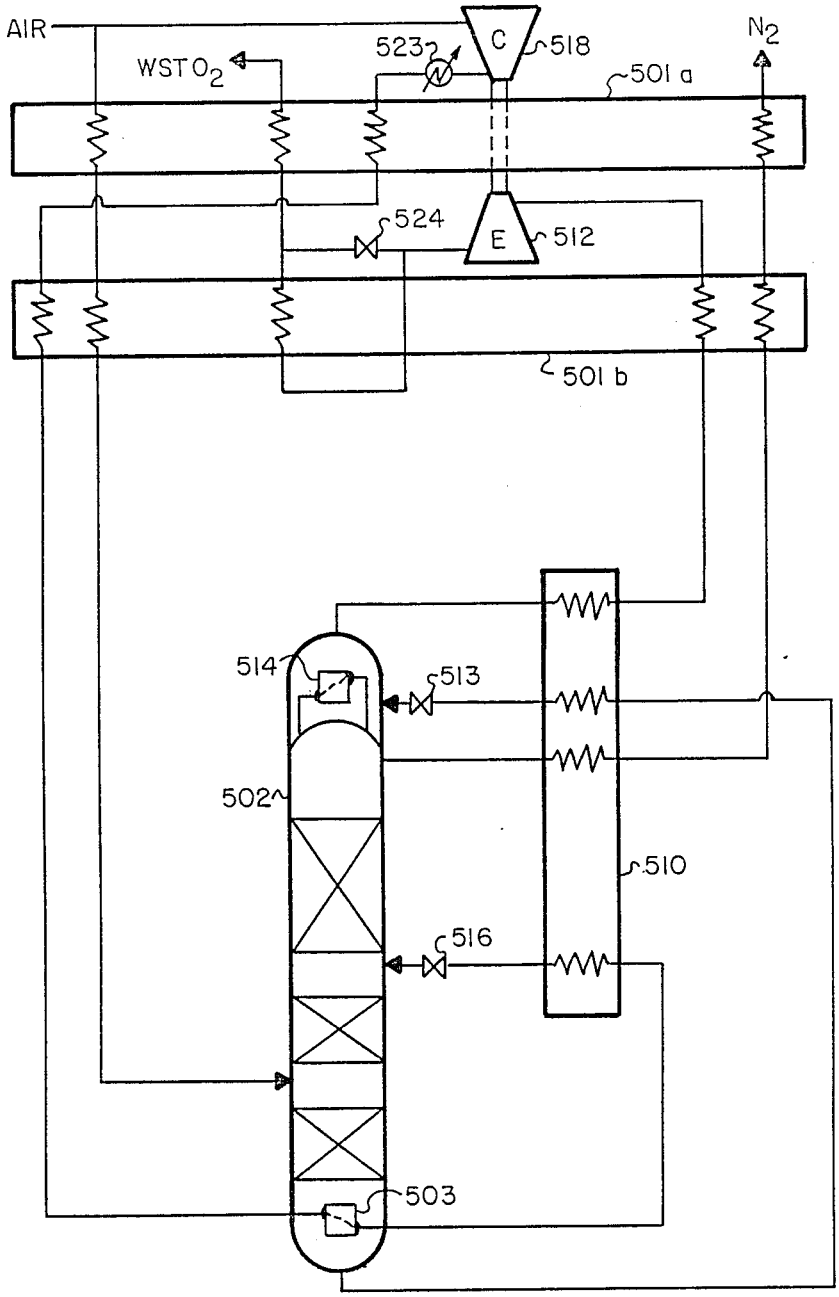
FIG. 5 is the simplest single pressure embodiment of the invention, having only a single compander which supplies TCFR air for bottoms reboil.
Figure 6:
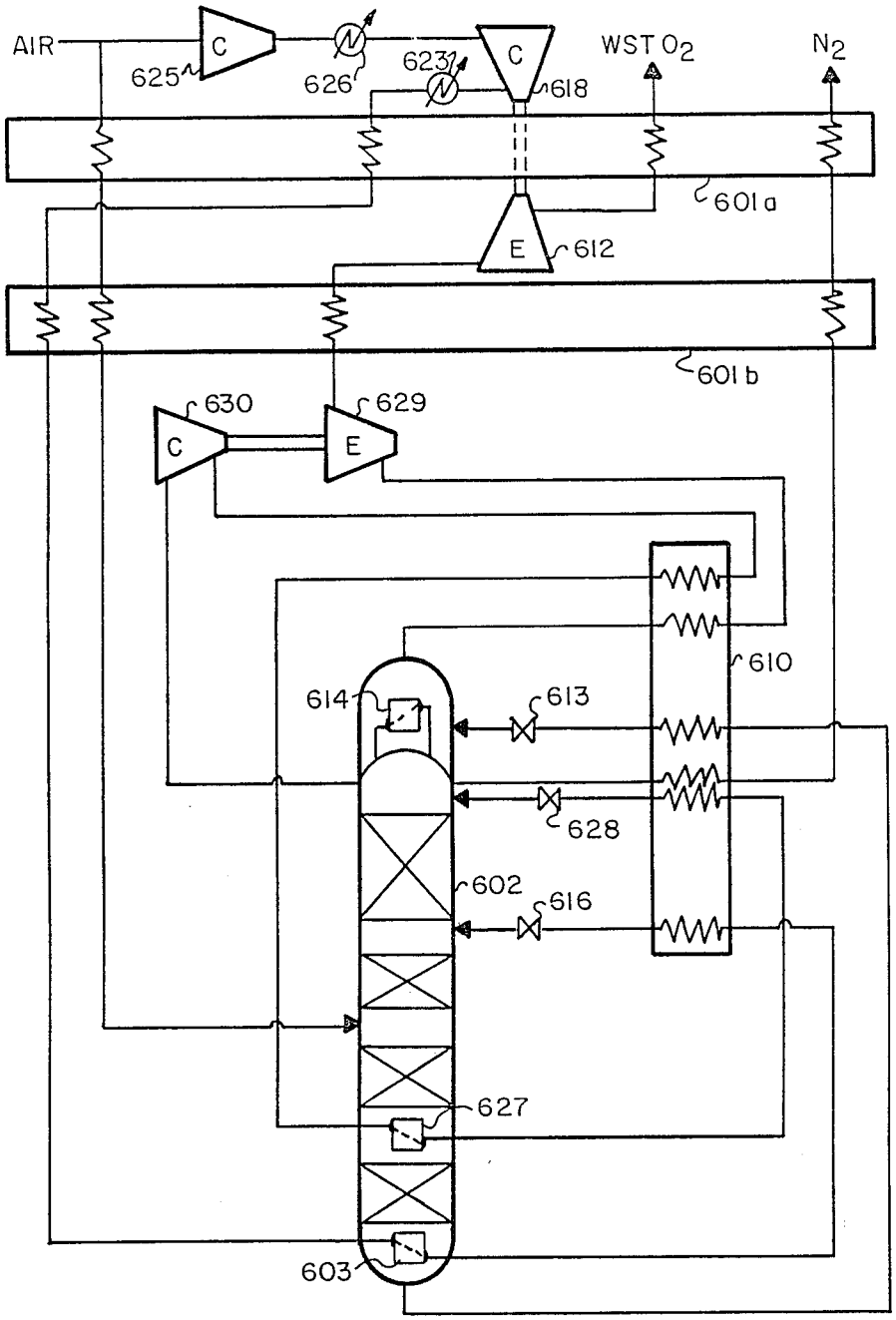
In FIG. 6, a second compander incorporating a cold $N_2$ compressor is added, for providing intermediate height reboil.

Turning to the single pressure embodiment of this invention, the simplest variation is illustrated in FIG. 5. The bulk of the compressed an cleaned air is cooled in main heat exchangers 501*a* and 501*b*, and fed to column 502. A very small fraction of the supply air, on the order of 5 to 7%, is routed to compressor 518 for additional compression through a ratio of about 1.4. It is cooled by optional cooler 523, main exchangers 501, and routed to reboiler 523. The resulting liquid air is cooled in cooler 510, depressurized by means for depressurization 516, and fed to an intermediate reflux height of column 502. Bottom liquid is also cooled in cooler 510, depressurized by means for depressurization 513, and then exchanges latent heat with column overhead vapor in reflux condenser 514. The evaporated bottom product (waste $O_2$) is partially warmed in exchanger 501*b*, expanded in expander 512, and discharged via exchanger 501*a* (plus optionally also 501*b*, by action of optional valve 524). Product $N_2$ is withdrawn from the column overhead via the main exchanger. The bottoms reboil afforded at reboiler 503 provides a significant increase in $N_2$ recovery over what is possible when all the supply air is fed to the bottom of the column, with no change in supply pressure. Recovery is still quite low, however. FIG. 6 illustrates a means of further increasing recovery, albeit at a higher required supply pressure.

In FIG. 6 the 600-series components which correspond to similar 500-series components oi FIG. 5 will not be further described, and only the differences will be recited. Higher $N_2$ recovery is obtained in a single pressure column by adding intermediate reboiler 627. The vapor feed to reboiler 627 is from a cold compander—compressor 630 directly compresses part of the overhead vapor from column 602, and a second expander 629, which also is fed waste $O_2$ (similar to expander 612) provides the drive power for compressor 630. Since the compander 629/630 is totally within the cold box, there is no net refrigeration effect—only expander 612 supplies net refrigeration. The waste $O_2$ pressure exiting reflux condenser 614 must be higher than in FIG. 5, since two expanders are to be powered by that pressure. Accordingly the column 602 pressure and the air supply pressure are also higher than with FIG. 1. The waste $O_2$ may be expanded in two sequential stages as shown, or alternatively can be expanded in two parallel stages as in FIG. 7. Frequently it will be desired to provide more additional compression than is possible with compressor 618 alone, and hence optional compressor 625 and cooler 626 are also illustrated. Obviously there are many alternative arrangements possible for exchange of sensible heat besides exchangers 610, 601*a* and *b*, without impacting the essence of the disclosed invention, which is basically concerned with the companders and the latent heat exchangers.

Figure 7:
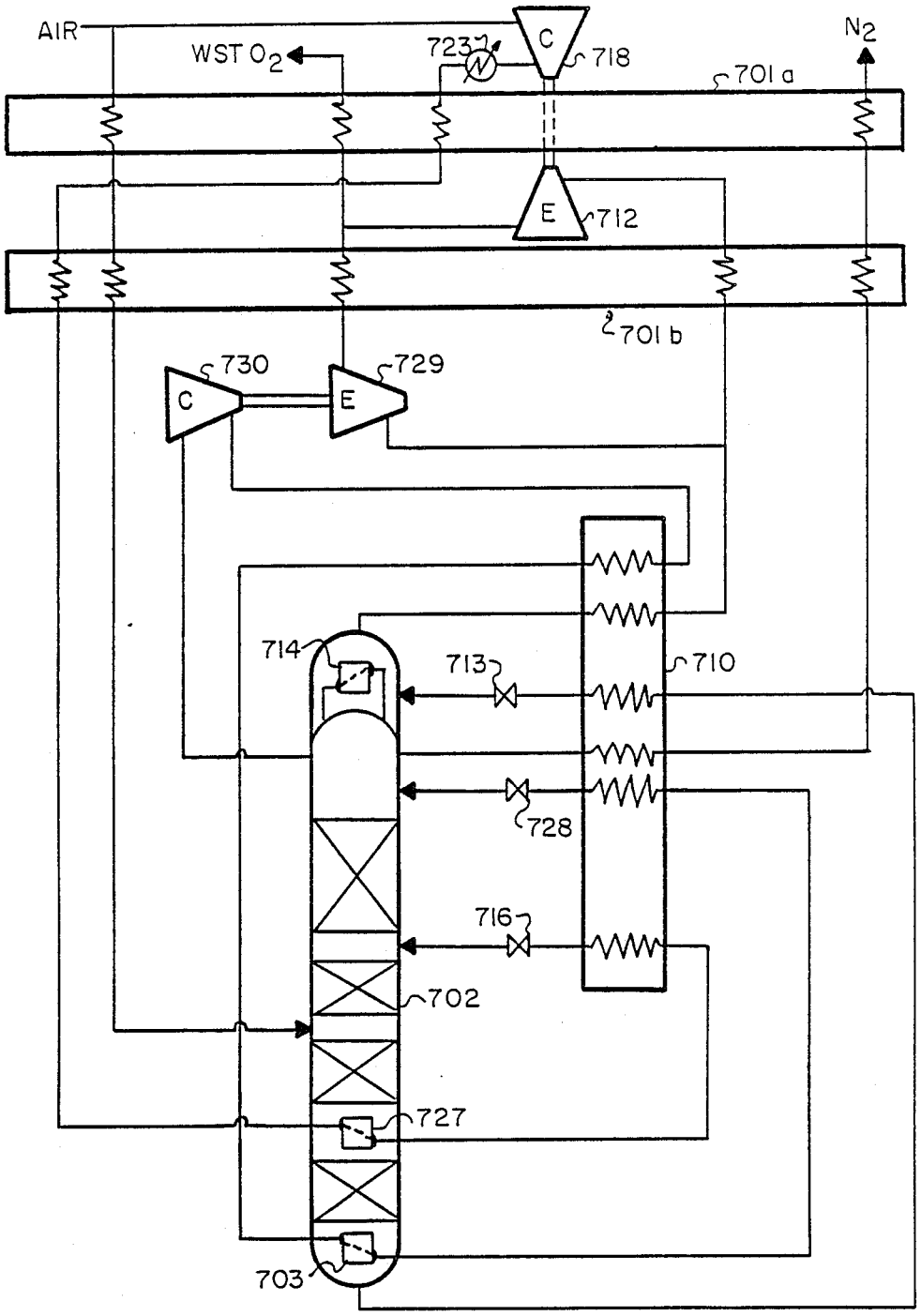
In FIG. 7, the heights of the two reboils are interchanged, with warm-companded air supplying the intermediate reboiler and cold-companded $N_2$ supplying the bottoms reboiler.

Similar remarks apply to FIG. 7, in which the location of the two reboilers for column 702 have been interchanged. The cold companded $N_2$ now supplies bottom reboiler 703, and additionally compressed totally condensing air supplies intermediate height reboiler 727. Since the air requires less compression, the compander alone is now sufficient, and no additional external boost compressor is required. Also, expanders 729 and 712 are illustrated in the parallel configuration.

I claim:

1. A process for producing at least nitrogen from pressurized and cleaned supply air in an apparatus comprised of a distillation column with bottoms reboiler and overhead reflux condenser, comprising:

(a) additionally compressing a minor fraction of said supply air;

(b) cooling both fractions of supply air to near the dewpoint;

(c) condensing said minor fraction to liquid air in a reboiler for said distillation column;
(d) feeding at least part of said liquid air to an intermediate reflux height of said distillation column;
(e) partially depressurizing the bottom liquid product from said distillation column and feeding it to said reflux condenser wherein it is evaporated;
(f) partially warming and work-expanding said evaporated bottom liquid, thereby providing refrigeration and shaft work;
(g) powering at least part of said additional compression by at least part of said shaft work; and
(h) withdrawing at least part of the product $N_2$ from the overhead of said distillation column.

2. Process according to claim 1 wherein said minor fraction consists of no more than about 25% of said supply air; and wherein said additional compression is through a pressure ratio of at least 1.07.

3. Process according to claim 2 additionally comprising feeding all of said liquid air, consisting of between 5 and 10% of all supply air, to said intermediate reflux height; and feeding said major fraction of supply air to said distillation column; and wherein said additionally compressed air is at least about 1.3 times the pressure of said supply air.

4. Process according to claim 3 additionally comprising condensing said minor air fraction in said bottoms reboiler.

5. Process according to claim 3 additionally comprising condensing said minor air fraction in an intermediate reboiler for said distillation column, and condensing a different vapor in said bottoms reboiler.

6. Prccess according to claim 5 additionally comprised of compressing part of the overhead vapor from said distillation column at below-ambient temperature; routing said compressed vapor to said bottoms reboiler; and feeding depressurized condensed compressed overhead vapor to the overhead of said distillation column as reflux therefor.

7. Process according to claim 2 additionally comprising feeding said major fraction of supply air to a high pressure (HP) rectifier; feeding the bottom liquid from said HP rectifier to said LP column in fluid phase at at least one feed height; condensing said liquid air in said bottoms reboiler of said distillation column; and feeding part of said liquid air to an intermediate reflux height of said HP rectifier.

8. Process according to claim 7 additionally comprising exchanging latent heat between HP rectifier overhead vapor and distillation column intermediate reboil height liquid.

9. Process according to claim 7 additionally comprising exchanging latent heat between HP rectifier overhead vapor and at least part of the depressurized bottom liquid from said HP rectifier; and feeding the resulting fluid to said distillation column.

10. Process according to claim 7 additionally comprising exchanging latent heat between HP rectifier overhead vapor and the bottom liquid from a zone of countercurrent vapor liquid contact; supplying at least part of the depressurized HP rectifier bottom liquid to the top of said contact zone; withdrawing at least partially vapor streams of differing $O_2$ composition from above and below said contact zone; and feeding said differing $O_2$ composition streams to different feed heights of said distillation column.

11. Apparatus designed, dimensioned, and adapted for the production of at least nitrogen from a supply of compressed and cleaned air comprising:
(a) a fractional distillation column with an overhead reflux condenser and a reboiler;
(b) a compander comprised of a warm-end compressor and a refrigeration expander;
(c) a means for routing not more than about 25% of said supply air to said warm-end compressor
(d) a means for depressurizing the bottom liquid from said distillation column and routing it to said reflux condenser;
(e) a means for cooling the discharge from said warm-end compressor to near its dewpoint and routing it to said reboiler;
(f) a means for depressurizing the liquid air effluent from said reboiler; and
(g) a means for feeding at least part of said depressurized liquid air to an intermediate reflux height of said distillation column.

12. Apparatus according to claim 11 additionally comprised of:
(a) a means for routing the remaining at least 75% of said supply air to the feed point of said column; and
(b) a means for routing at least part of the effluent vapor from said reflux condenser to said refrigeration expander.

13. Apparatus according to claim 12 wherein said reboiler is an intermediate height reboiler, and additionally comprised of:
(a) a second compander comprised of cold-end compressor and drive expander
(b) a bottoms reboiler for said distillation column;
(c) a means for routing overhead vapor from said column to said cold compressor;
(d) a means for routing compressed vapor from said cold compressor to said bottoms reboiler; and
(e) a means for depressurizing the liquid from said bottoms reboiler and feeding it to the overhead of said column as reflux therefor.

14. Apparatus according to claim 11 additionally comprised of:
(a) a high pressure rectifier;
(b) a means for supplying the remaining at least 75% of said supply air to said HP rectifier;
(c) a means for routing the effluent vapor from said reflux condenser to said refrigeration expander; and
(d) a means for dividing the liquid air from said reboiler into two fractions for feeding to respective intermediate reflux heights of said distillation column and said HP rectifier.

15. Apparatus according to claim 14 additionally comprised of:
(a) a reflux condenser for said HP rectifier;
(b) a zone of countercurrent vapor-liquid contact positioned so as to supply bottom liquid to and obtain reboil vapor from said HP rectifier reflux condenser;
(c) a means for routing depressurized HP rectifier bottom liquid to the top of said contact zone; and
(d) two separate means for routing respective vapor streams from above and below said contact zone to different heights of said distillation column.

16. Process for separating at least nitrogen from compressed and cleaned air by fractional distillation in a dual pressure apparatus comprised of a HP rectifier and a distillation column, comprising:

(a) routing at least the uncondensed portion of a major fraction of said supply air to the bottom of said HP rectifier;
(b) depressurizing the bottom liquid from said HP rectifier to the approximate pressure of the distillation column;
(c) distilling said HP rectifier bottom liquid to at least two vapor streams of differing composition; and
(d) feeding each of said vapor streams to a different height of said distillation column.

17. Process according to claim 16 additionally comprising:
(a) exchanging latent heat between HP rectifier overhead vapor and said depressurized HP rectifier bottom liquid undergoing distillation; and
(b) exchanging latent heat between distillation column overhead vapor and depressurized distillation column bottom liquid.

18. Process according to claim 17 additionally comprising:
(a) additionally compressing a minor fraction not exceeding 25% of said supply air through a compression ratio of at least 1.07;
(b) reboiling the bottom oi said distillation column by exchanging latent heat with said additionally compressed air;
(c) dividing the liquid air from said distillation column bottoms reboiler into respective intermediate height reflux streams ior said HP rectifier and said distillation column; and
(d) powering said additional compression by expanding a vapor stream and producing refrigeration.

19. Process according to claim 17 additionally comprising:
(a) reboiling the bottom of said distillation column by partially condensing said supply air while exchanging latent heat with the column bottom liquid, prior to feeding at least the uncondensed portion to said HP rectifier.

20. Apparatus for producing at least nitrogen from a supply of compressed and cleaned air comprising:
(a) a high pressure rectifier;
(b) a distillation column;
(c) a reflux condenser for said HP rectifier which is in fluid communication with the bottom of a zone of countercurrent vapor-liquid contact:
(d) a means for depressurizing and routing at least part of the bottom liquid from said HP rectifier to the top of said contact zone;
(e) a means for routing vapor from above said contact zone to an intermediate height of said distillation column; and
(f) a means for routing vapor from below said contact zone to a lower height of said distillation column.

21. Apparatus according to claim 20 additionally comprised of:
(a) a compander which additionally compresses a minor fraction of said supply air and which expands a process vapor stream to supply refrigeration; and
(b) a reboiler for said distillation column which is supplied said additionally compressed air.

22. Apparatus for separating at least nitrogen from a supply of compressed and cleaned air comprising:
(a) a single pressure distillation column;
(b) an overhead reflux condenser for said column;
(c) a means for supplying depressurized column bottom liquid to said overhead reflux condenser;
(d) an expander;
(e) a means for partially warming the evaporated column bottom product from said reflux condenser and supplying at least part of it to said expander;
(f) a compressor which is powered by said expander
(g) a means for routing part of the overhead vapor from said column to said compressor while cold;
(h) a bottoms reboiler for said column;
(i) a means for routing compressed overhead vapor from said compressor to said bottoms reboiler; and
(j) a means for depressurizing the condensed overhead vapor from said bottoms reboiler and feeding it to the overhead of said column.

23. Apparatus according to claim 22 additionally comprised of:
(a) a second expander which is also supplied at least part of said evaporated bottom product and which produces refrigeration;
(b) a warm compressor powered by said expander which additionally compresses less than about 10% of said air;
(c) an intermediate height reboiler for said column;
(d) a means for routing said additionally compressed air to said intermediate reboiler; and
(e) a means for routing depressurized liquid air from said intermediate reboiler to an intermediate reflux height of said column.

* * * * *